US009159281B2

(12) United States Patent
Tsuei et al.

(10) Patent No.: US 9,159,281 B2
(45) Date of Patent: Oct. 13, 2015

(54) DISPLAY AND DRIVING METHOD THEREOF

(71) Applicant: Innolux Corporation, Miao-Li County (TW)

(72) Inventors: Bo-Chin Tsuei, Miao-Li County (TW); Yao-Lien Hsieh, Miao-Li County (TW); Jian-Cheng Chen, Miao-Li County (TW); Chung-Yi Wang, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 143 days.

(21) Appl. No.: 13/908,010

(22) Filed: Jun. 3, 2013

(65) Prior Publication Data

US 2013/0328756 A1 Dec. 12, 2013

(30) Foreign Application Priority Data

Jun. 6, 2012 (TW) ..... 101120319 A

(51) Int. Cl.
*G09G 3/36* (2006.01)
*G09G 3/18* (2006.01)

(Continued)

(52) U.S. Cl.
CPC ..... *G09G 3/3611* (2013.01); *G09G 3/3648* (2013.01); *G09G 3/3655* (2013.01); *G09G 2320/02* (2013.01); *G09G 2320/0233* (2013.01);

(Continued)

(58) Field of Classification Search
USPC ..... 345/213, 211, 92, 99, 87, 690; 349/78
See application file for complete search history.

(56) References Cited

U.S. PATENT DOCUMENTS

2004/0196235 A1* 10/2004 Koyama et al. ..... 345/89
2008/0074148 A1* 3/2008 Srivastava et al. ..... 326/68

(Continued)

OTHER PUBLICATIONS 31.1: Invited Paper: World's First 240Hz TFT-LCD Technology for Full-HD LCD-TV and Its Application to 3D Display Sang Soo Kim, Bong Hyun You, Heejin Choi, Brian H. Berkeley, Dong Gyu Kim, and Nam Deog Kim ISSN/009-0966X/09/3901-0424-$1.00 © 2009 SID.*

(Continued)

*Primary Examiner* — Srilakshmi K Kumar
*Assistant Examiner* — Deeprose Subedi
(74) *Attorney, Agent, or Firm* — McClure, Qualey & Rodack, LLP

(57) ABSTRACT

A driving method applied in a display is provided. The display includes M scan lines, N data lines, M control lines and M×N pixels. M and N are natural numbers greater than 1. The driving method includes the following steps of: driving M scan lines in M scan periods respectively; providing a data voltage to each of the N data lines in each of the M scan periods; driving the first to the $(M-K)^{th}$ control lines in the $(K+1)^{th}$ to the $M^{th}$ scan periods respectively to turn on the discharge switch in each of the pixels on the first to the $(M-K)^{th}$ control lines; and driving the second to the $K^{th}$ control lines to trigger level shifting events in the first to the $(K-1)^{th}$ scan periods respectively, so that level shifting events are triggered on a scan and control lines in the first to the $(K-1)^{th}$ scan periods.

16 Claims, 9 Drawing Sheets

(51) Int. Cl.
*G09G 3/296* (2013.01)
*G09G 5/18* (2006.01)

(52) U.S. Cl.
CPC .... *G09G 2320/0271* (2013.01); *G09G 2320/04* (2013.01); *G09G 2320/043* (2013.01); *G09G 2320/062* (2013.01); *G09G 2320/0613* (2013.01); *G09G 2320/0626* (2013.01); *G09G 2320/0646* (2013.01)

(56) References Cited

U.S. PATENT DOCUMENTS

2008/0129904 A1* 6/2008 Kang et al. ..... 349/37
2008/0224978 A1* 9/2008 Park ..... 345/92
2009/0079767 A1* 3/2009 Morita ..... 345/690
2009/0135323 A1* 5/2009 Yang et al. ..... 349/37
2009/0316779 A1* 12/2009 Fukuhara et al. ..... 375/240.02
2011/0095967 A1* 4/2011 Choi ..... 345/76
2011/0134100 A1* 6/2011 Chung et al. ..... 345/212
2011/0273428 A1* 11/2011 Han et al. ..... 345/212
2011/0279484 A1* 11/2011 Han et al. ..... 345/690
2012/0162275 A1* 6/2012 Park ..... 345/690
2012/0182283 A1* 7/2012 Park ..... 345/212

OTHER PUBLICATIONS 34.3: A Novel Charge-Shared S-PVA Technology Seung Beom Park, Jaejin Lyu, Yoonsung Um, Heewook Do, Soonil Ahn, Kwangsoo Choi, Kyeong-Hyeon Kim, and Sang Soo Kim Development Center, LCD Business, Samsung Electronics Co., Ltd Tangjeong-Myeon, Asan-City, Chungcheongnam-Do, Korea (ROK) ISSN/007-0966X/07/3802-1252-$1.00 © 2007 SID.*
U.S. Appl. No. 13/755,799, filed Jan. 31, 2013.

* cited by examiner

DISPLAY AND DRIVING METHOD THEREOF

This application claims the benefit of Taiwan application Serial No. 101120319, filed Jun. 6, 2012, the subject matter of which is incorporated herein by reference.

BACKGROUND OF THE INVENTION

1. Field of the Invention

The invention relates in general to a display and a driving method thereof, and more particularly to a display applying low color shift (LCS) technology and a driving method thereof.

2. Description of the Related Art

Liquid crystal display (LCD), having the advantages of small volume, light weight and low radiation, has been widely used in various fields of application. In general, a liquid crystal display includes an LCD panel and a backlight module. The LCD panel determines the transmission of each pixel in response to a display data voltage applied thereon. The backlight module uniformly projects a back light to the LCD panel. Thus, the liquid crystal display may correspondingly display the display data.

Since the voltage-transmission curve of each pixel varies with the user's viewing angle (relative to the display surface of the liquid crystal display), color shift arises accordingly. In terms of the existing charge sharing low color shift (LCS), corresponding display areas of different scan lines of the liquid crystal display have different brightness levels, hence resulting in band mura. Therefore, how to provide an LCS liquid crystal display capable of effectively reducing the band mura effect and a driving method has become a prominent task for the industries.

SUMMARY OF THE INVENTION

According to one embodiment of the present invention, a display including a first substrate, a second substrate, a scan driver, a data driver and a control driver is provided. The first substrate has a common electrode. The second substrate includes M scan lines, N data lines, M control lines, several metal lines and M×N pixels, wherein M and N are natural numbers greater than 1, and several metal lines are disposed on the second substrate and correspond to the common electrode. The $(i,j)^{th}$ of the M×N pixels includes a first sub-pixel and a second sub-pixel. The first sub-pixel is electrically connected to the $i^{th}$ scan line and the $j^{th}$ data line, wherein i and j respectively are a natural number smaller than or equal to M and a natural number smaller than or equal to N, and the second sub-pixel is electrically connected to the ith scan line, the jth data line and the ith control lines and further has a discharge switch. The scan driver is electrically connected to each of the M scan lines for providing M scan signals to drive M scan lines in M scan periods respectively. The data driver is electrically connected to N data lines for providing a data voltage to each of the N data lines in each of the M scan periods. The control driver is electrically connected to each of the M control lines for providing (M−K) control signals to drive the first to the $(M-K)^{th}$ control lines in the $(K+1)^{th}$ to the $M^{th}$ scan periods respectively to turn on the discharge switch in each of the pixels on the first to the $(M-K)^{th}$ control lines. The control driver further drives one of the metal lines to trigger a level shifting event in each of the first to the $K^{th}$ scan periods, so that a level shifting event is correspondingly triggered on a scan line and a metal line in each of the first to the $K^{th}$ scan periods.

According to another embodiment of the present invention, a display including a first substrate, a second substrate, a scan driver, a data driver and a control driver is provided. The first substrate has a common electrode. The second substrate includes M scan lines, N data lines, M control lines and M×N pixels, wherein M and N are natural numbers greater than 1. The $(i,j)^{th}$ of the M×N pixels includes a first sub-pixel and a second sub-pixel. The first sub-pixel is electrically connected to the $i^{th}$ scan line and the $j^{th}$ data line, wherein i and j respectively are a natural number smaller than or equal to M and a natural number smaller than or equal to N. The second sub-pixel is electrically connected to the $i^{th}$ scan line, the $j^{th}$ data line and the $i^{th}$ control lines, and further has a discharge switch. The scan driver is electrically connected to each of the M scan lines for providing M scan signals to drive M scan lines in M scan periods respectively. The data driver is electrically connected to N data lines for providing a data voltage to each of the N data lines in each of the M scan periods. The control driver is electrically connected to each of the M control lines for providing (M−K) control signals to drive the first to the $(M-K)^{th}$ of the M control lines in the $(K+1)^{th}$ to the $M^{th}$ scan periods respectively to turn on the discharge switch in each of the pixels on the first to the $(M-K)^{th}$ control lines. The control driver further drives the second to the $K^{th}$ M control lines to trigger level shifting events in the first to the $(K-1)^{th}$ scan periods respectively, so that level shifting events are triggered on a scan line and a control line in the first to the $(K-1)^{th}$ scan periods.

According to an alternate embodiment of the present invention, a driving method applied in a display is provided. The display includes a first substrate, a second substrate, a scan driver, a data driver and a control driver. The first substrate has a common electrode. The second substrate includes M scan lines, N data lines, M control lines, several metal lines and M×N pixels, wherein M and N are natural numbers greater than 1. The metal lines are disposed on the second substrate, and correspond to the common electrode. Each of the M×N pixels includes a first sub-pixel and a second sub-pixel. The second sub-pixel further has a discharge switch. The driving method includes the following steps of: applying the scan driver to provide M scan signals to drive M scan lines in the M scan periods respectively; applying the data driver to provide a data voltage to each of the N data lines in each of the M scan periods; applying the control driver to provide (M−K) control signals to drive the first to the $(M-K)^{th}$ of the M control lines in the $(K+1)^{th}$ to the $M^{th}$ scan periods respectively to turn on the discharge switch in each of the pixels on the first to the $(M-K)^{th}$ control lines; and applying the control driver to drive one of the metal lines to trigger a level shifting event in each of the first to the $K^{th}$ scan periods, so that a level shifting event is correspondingly triggered on a scan line and a metal line in each of the first to the $K^{th}$ scan periods.

According to another alternate embodiment of the present invention, a driving method applied in the display is provided. The display includes a first substrate, a second substrate, a scan driver, a data driver and a control driver. The first substrate has a common electrode. The second substrate includes M scan lines, N data lines, M control lines and M×N pixels, wherein M and N are natural numbers greater than 1. Each of the M×N pixels includes a first sub-pixel and a second sub-pixel. The second sub-pixel further has a discharge switch. The driving method includes the following steps of: applying the scan driver to provide M scan signals to drive M scan lines in the M scan periods respectively; applying the data driver to provide a data voltage to each of the N data lines in each of the M scan periods; applying the control driver to drive the first to the $(M-K)^{th}$ of the M control lines to provide (M−K) control signals in the $(K+1)^{th}$ to the $M^{th}$ scan periods respectively to turn on the discharge switch in each of the pixels on the first to the $(M-K)^{th}$ control lines; and applying the control driver to drive the second to the $K^{th}$ of the M control lines to trigger level shifting events in the first to the $(K-1)^{th}$ scan periods respectively, so that level shifting events are triggered on a scan line and a control line in the first to the $(K-1)^{th}$ scan periods.

The above and other aspects of the invention will become better understood with regard to the following detailed description of the preferred but non-limiting embodiment(s). The following description is made with reference to the accompanying drawings.

DETAILED DESCRIPTION OF THE INVENTION

First Embodiment

In the display of the present embodiment, a plurality of metal lines capable of forming equivalent capacitance with a common electrode is disposed on a second substrate. By triggering voltage level shifting events on the metal lines, substantially the same capacitance coupling events are triggered with respect to the common electrode in all scan periods, so that the common electrode has stable voltage level in all scan periods.

Figure 1:
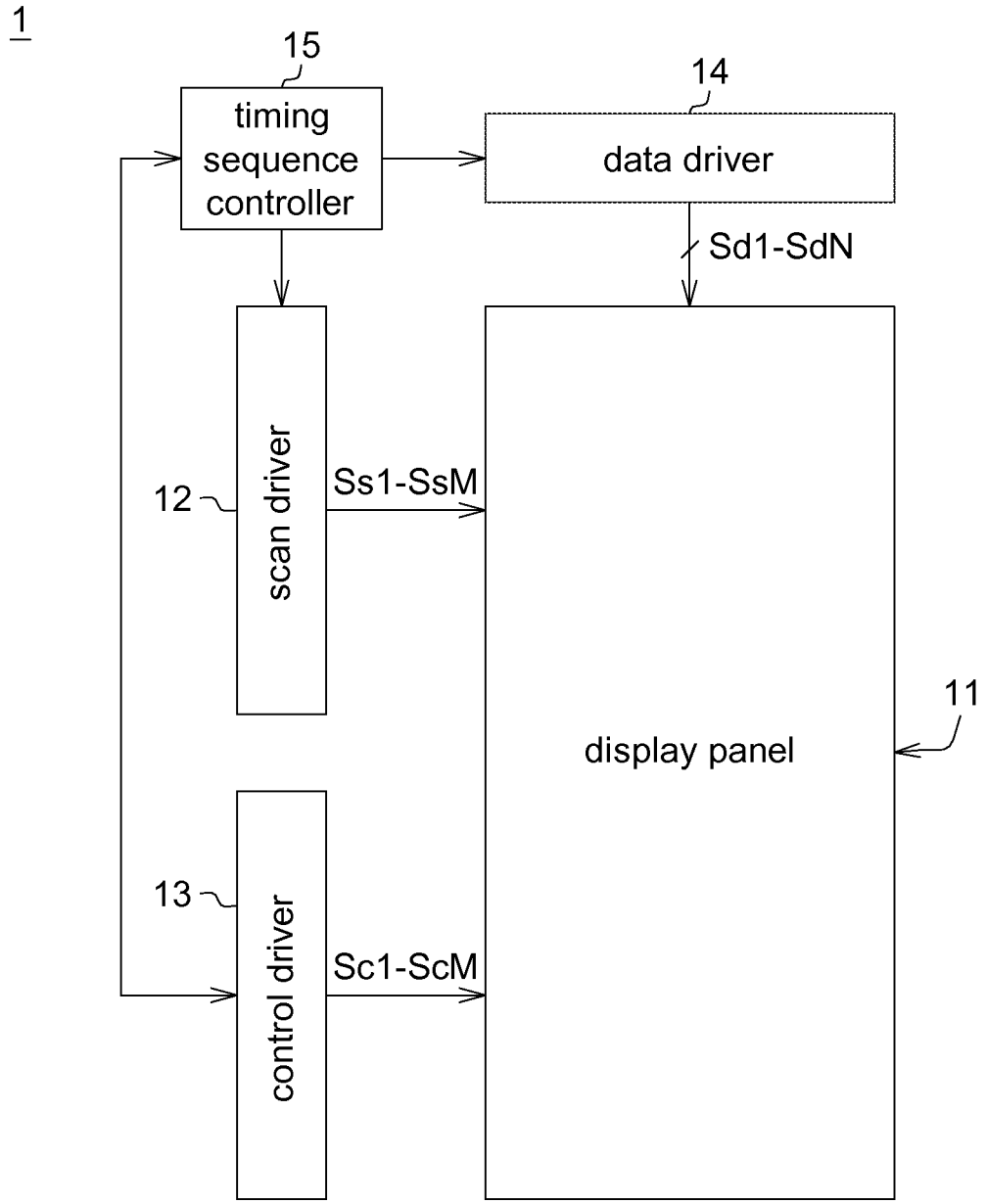
FIG. 1 shows a block diagram of a display according to a first embodiment of the invention.

Referring to FIG. 1, a block diagram of a display according to a first embodiment of the invention is shown. The display 1 of the present embodiment, realized by such as an active matrix liquid crystal display (LCD) device, includes a display panel 11, a scan driver 12, a control driver 13, a data driver 14 and a timing sequence controller 15.

Figure 2A:
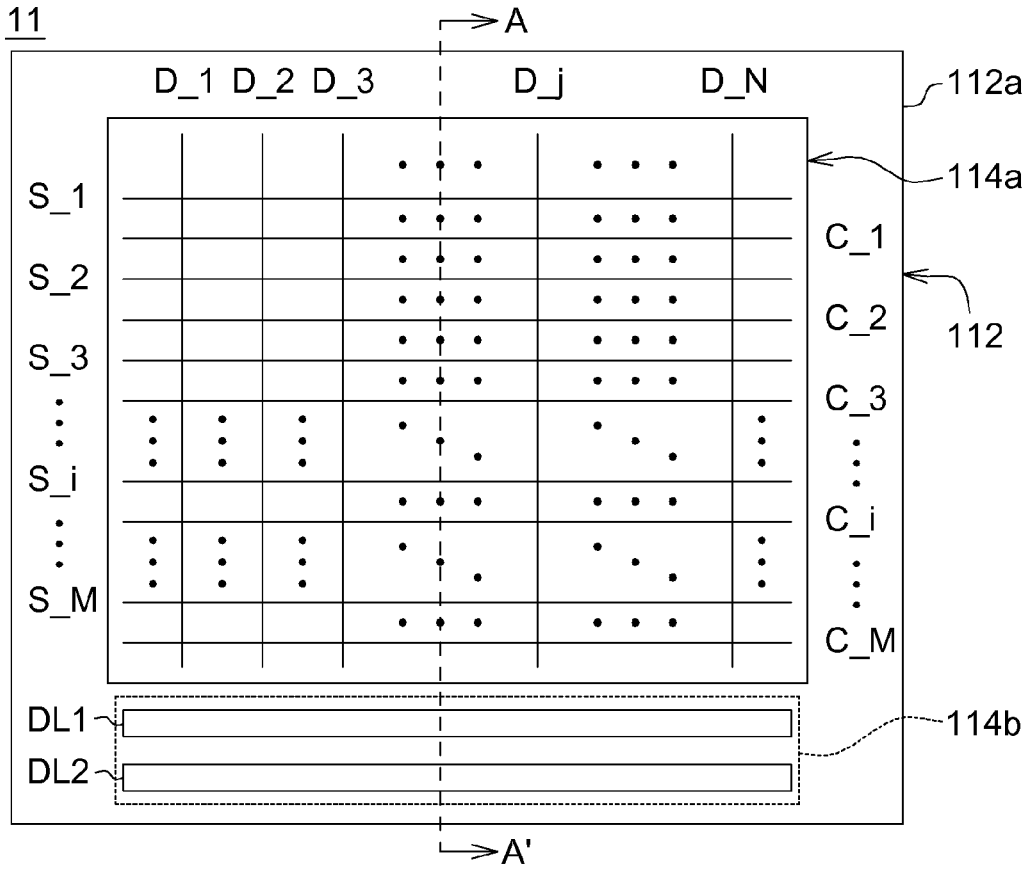
FIGS. 2A and 2B respectively show a top view of a display panel 11 according to a first embodiment of the invention and a cross-sectional view of a display panel 11 along cross-sectional line A-A'.
Figure 2B:
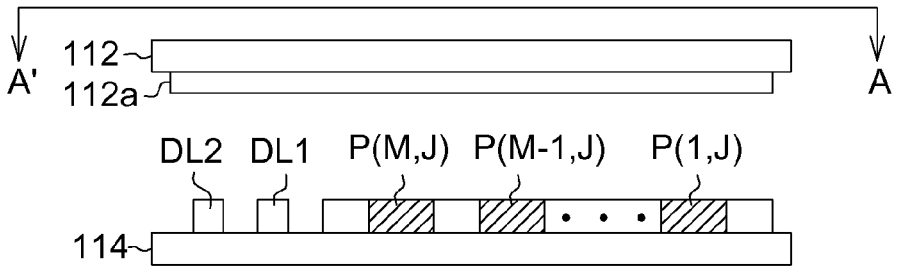

Referring to FIGS. 2A and 2B, a top view of a display panel 11 according to a first embodiment of the invention and a cross-sectional view of a display panel 11 along cross-sectional line A-A' are respectively shown. The display panel 11 includes a first substrate 112 and a second substrate 114. The first substrate 112 has a common electrode 112*a*. The second substrate 114 includes an opening area 114*a* in which M scan lines S_1~S_M, N data lines D_1~D_N, M control lines C_1~C_M and M×N pixels P(1,1)~P(M,N) are disposed, wherein M and N are natural numbers greater than 1. The second substrate 114 further includes a blocking area 114*b* in which metal lines DL1 and DL2 are disposed. The blocking area 114*b* is disposed on the second substrate 114 and corresponds to the common electrode 112*a*. Furthermore, metal lines DL1 and DL2 are substantially covered by the common electrode 112*a*.

Each of the M×N pixels P(1,1)~P(M,N) substantially has a similar circuit structure. The structures of the M×N pixels P(1,1)~P(M,N) are exemplified by an $(i,j)^{th}$ pixel P(i,j), wherein i and j respectively are a natural number smaller than or equal to M and a natural number smaller than or equal to N.

Figure 3:
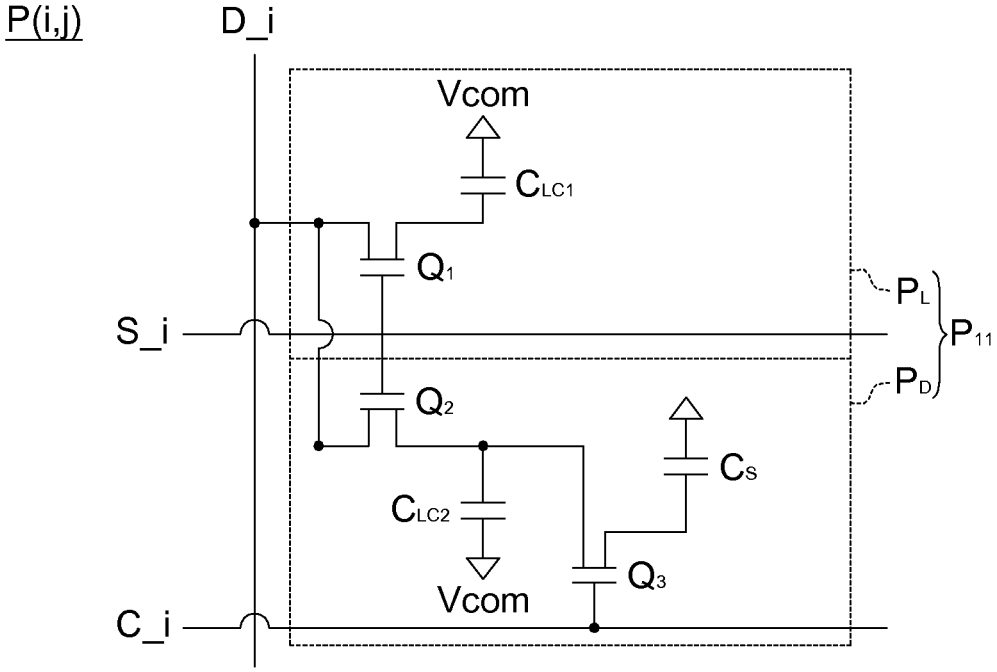
FIG. 3 shows a schematic diagram of pixel P(i,j) according to a first embodiment of the invention.

Referring to FIG. 3, a schematic diagram of pixel P(i,j) according to a first embodiment of the invention is shown. The pixel P(i,j) includes sub-pixels $P_L$ and $P_D$. The sub-pixel $P_L$ is electrically connected to the scan line S_i and the data line D_i, and includes a charge switch $Q_1$ and a liquid crystal capacitor $C_{LC1}$. For example, the charge switch $Q_1$ is implemented by a thin film transistor (TFT) whose first source/drain is coupled to the data line D_i, second source/drain is coupled to the liquid crystal capacitor $C_{LC1}$, and gate end is coupled to the scan line S_i.

The sub-pixel $P_D$ is electrically connected to the scan line S_i, the data line D_i and the control line C_i, and includes a charge switch $Q_2$, a discharge switch $Q_3$, a liquid crystal capacitor $C_{LC2}$ and a discharge capacitor $C_S$. For example, the charge switch $Q_2$ and the discharge switch $Q_3$ may also be implemented by a TFT. In the charge switch $Q_2$, the first source/drain is coupled to the data line D_i, the second source/drain is coupled to the liquid crystal capacitor $C_{LC2}$, and the gate end is coupled to the scan line S_i. In the discharge switch $Q_3$, the first source/drain is coupled to liquid crystal capacitor $C_{LC2}$, the second source/drain is coupled to the discharge capacitor $C_S$, and the gate end is coupled to the control line C_i.

For the pixel P(i,j), the charge switches $Q_1$ and $Q_2$ are enabled in response to an enabled scan signal Ssi (provided on the scan line S_i) for storing a data voltage on the data line D_j to the liquid crystal capacitors $C_{LC1}$ and $C_{LC2}$. The discharge switch $Q_3$ is enabled in response to an enabled control signal Sci (provided on the control line C_i) for sharing charges on the liquid crystal capacitor $C_{LC2}$ to the discharge capacitor $C_S$.

Referring to FIG. 1 again. The scan driver 12 is electrically connected to each of the M scan lines S_1~S_M for providing M scan signals Ss1~SsM to drive M scan lines S_1~~S_M in M scan periods TP_1~TP_M respectively. The data driver 14 is electrically connected to N data lines D_{1~D}_N for providing data voltages Sd1~SdN to each of the N data lines D_1~D_N in each of M scan periods TP_1~TP_M.

The control driver 13 is electrically connected to each of the M control lines C_1~C_M for providing enabled control signals Sc1~ScM-K to drive the first to the $(M-K)^{th}$ control lines C_1~C_(M-K) in the $(K+1)^{th}$ to the $M^{th}$ scan periods TP_K+1~TP_M respectively to turn on the discharge switch in each of the pixels on the first to the $(M-K)^{th}$ control lines C_1~C_M-K, wherein K is a natural number smaller than or equal to M. The control driver 13 further drives one of the metal lines DL1 and DL2 to trigger a level shifting event in each of the first to the $K^{th}$ scan periods TP_1~TP_K.

Figure 4:
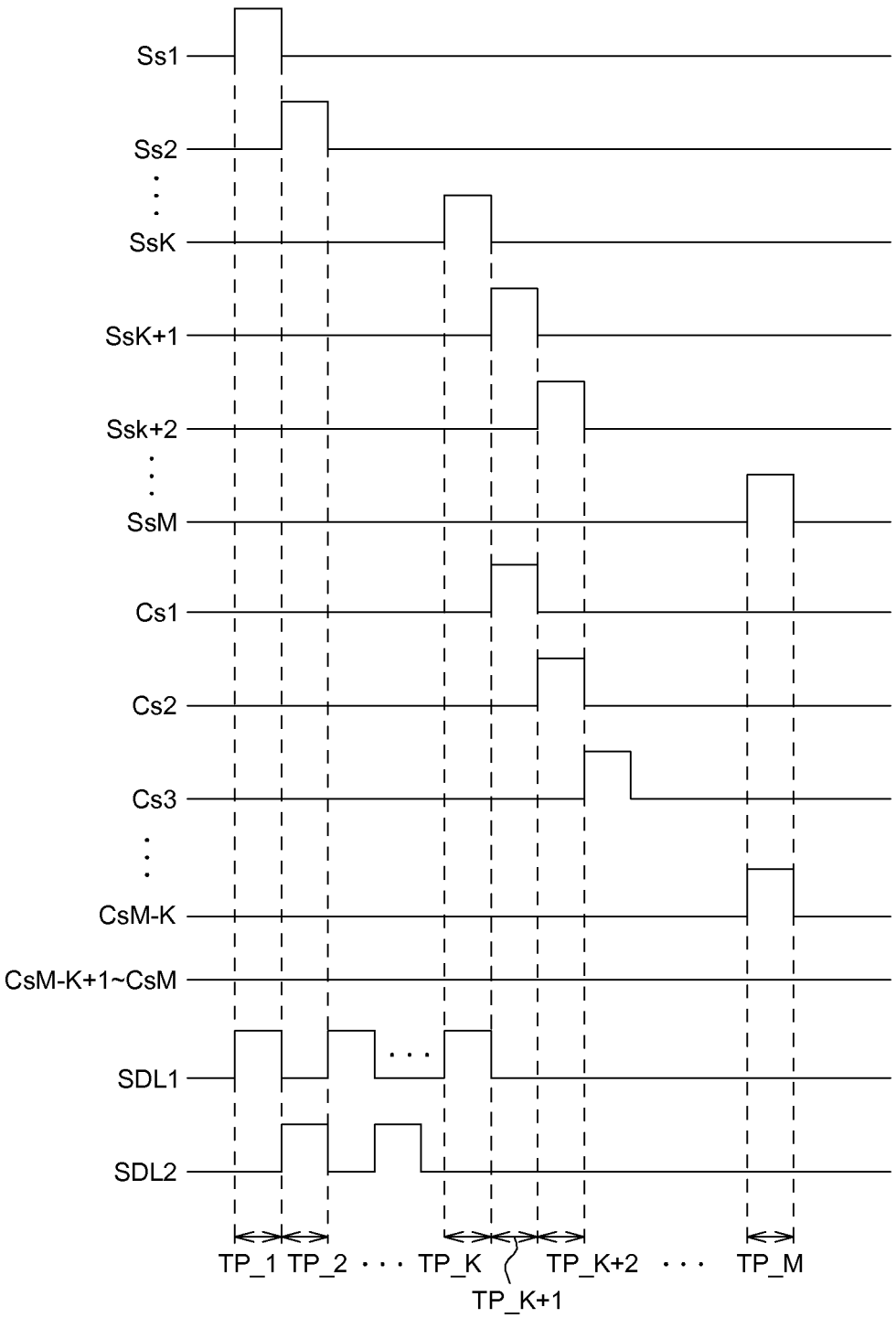
FIG. 4 shows related signal timing diagrams of a display 1 according to a first embodiment of the invention.

Referring to FIG. 4, related signal timing diagrams of a display 1 according to a first embodiment of the invention are shown. Furthermore, the scan driver 12 provides enabled scan signals Ss1~SsM (corresponding to high signal level) in scan periods TP_1~TP_M respectively, and provides non-enabled scan signals Ss1~SsM (corresponding to low signal levels) in scan periods other than TP_1~TP_M. In addition, in each of scan periods TP_1~TP_M, the data driver 14 further correspondingly provides data voltages Sd1~SdN to each of the N data lines D_1~D_N for writing corresponding data voltages to pixels on the corresponding pixel row. Suppose each pixel has a circuit diagram as indicated in FIG. 3. The charge switches $Q_1$ and $Q_2$ are turned on in response to the enabled scan signals for storing corresponding data voltages to the liquid crystal capacitors $C_{LC1}$ and $C_{LC2}$.

The control driver 13 provides enabled control signals Sc1~Sc(M−K) (corresponding to high signal levels) in scan periods TP_K+1~TP_M respectively, and provides non-enabled control signals ScK+1~ScM (corresponding to low signal level) in scan periods other than scan periods TP_K+1~TP_M. The control signals ScM-K+1~ScM continuously are non-enabled in scan periods TP_1~TP_M. In other words, for each of the pixels P(1,1)~P(M−K,N) on the first to the $(M-K)^{th}$ pixel rows of the display panel 11, the charge switches $Q_1$ and $Q_2$ write corresponding data voltages to the liquid crystal capacitors $C_{LC1}$ and $C_{LC2}$. In K scan periods after corresponding data voltages are written to the liquid crystal capacitors $C_{LC1}$ and $C_{LC2}$, the discharge switch $Q_3$ is turned on in response to corresponding control signals to share charges on the liquid crystal capacitor $C_{LC2}$ to the discharge capacitor $C_S$. Since the sub-pixels $P_L$ and $P_D$ of each of the pixels P(1,1)~P(M−K,N) on the first to the $(M-K)^{th}$ pixel rows correspond to different data voltages, the sub-pixels $P_L$ and $P_D$ have different liquid crystal inclination angles and the low color shift (LCS) display technology is correspondingly implemented.

For each of the pixels P(M−K+1,1)~P(M,N) on the $(M-K+1)^{th}$ to the $M^{th}$ pixel rows of the display panel 11, its corresponding control signals ScM−K+1~ScM are continuously non-enabled in scan periods TP_1~TP_M. Thus, each of the pixels P(M−K+1,1)~P(M,N) on the $(M-K+)^{th}$ to the $M^{th}$ pixel rows substantially is not designed to perform the abovementioned charge operation between the liquid crystal capacitor $C_{LC2}$ and the discharge capacitor $C_s$.

Under the abovementioned driving operation of the control driver 13, level shifting event occurs on only one metal wire (corresponding to scan line S_1 to S_K) in each of the scan periods TP_1~TP_K, but occurs on two metal wires concurrently (corresponding to scan lines S_K+1~S_M and control lines C_1~C_M−K) in each of the scan periods TP_K+1~TP_M. In addition, the scan lines or the control lines and the common electrode 112*a* may be equivalently used as a parasitic capacitor, and the voltage level shifting events triggered thereon correspondingly affect the voltage level on the common electrode 112*a* through the capacitance coupling effect.

Figure 5:
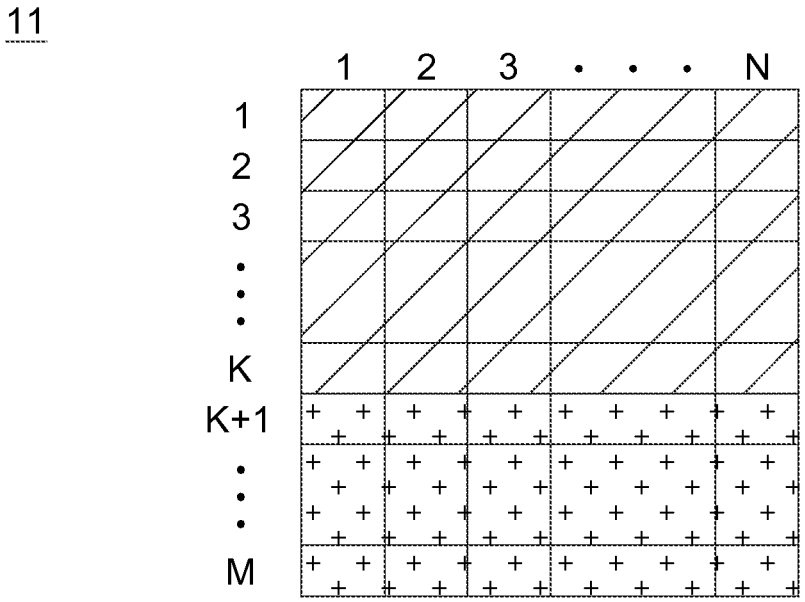
FIG. 5 shows a display diagram of a display 1 according to a first embodiment of the invention.

In terms of the display 1 of the present embodiment, the number of metal wires (that is, only one metal wire) on which level switching event occurs in scan periods TP_1~TP_K is not equal to the number of metal wires (that is, two metal wires) on which level switching event occurs in periods TP_K+1~TP_M. Thus, the common electrode 112*a* face different intensities of capacitance coupling effect in the two sets of scan periods disclosed above, and accordingly correspond to different voltage levels. Thus, the brightness in the first to the $K^{th}$ pixel rows of the display 1 will be different from the brightness in the $(K+1)^{th}$ to the $M^{th}$ pixel rows, hence resulting in band mura as illustrated FIG. 5. In FIG. 5, the first to the $K^{th}$ pixel rows of the display 1 are denoted by "/" and the $(K+1)^{th}$ to the $M^{th}$ pixel rows are denoted by "+".

To resolve the above band mura problem which jeopardizes display quality, the control driver 13 of the present embodiment drives one of the metal lines DL1 and DL2 to trigger a level shifting event in each of the first to the $K^{th}$ scan periods TP_1~TP_K. In the example illustrated in FIG. 4, a level shifting event is triggered on the metal line DL1 in odd-numbered scan periods of the scan periods TP_1~TP_K, and is triggered on the metal line DL2 in even-numbered scan periods of the scan periods TP_1~TP_K. Through the driving operation of the control driver 13, level shifting events are triggered on two metal lines in any of the M scan periods TP_1~TP_M, so that the common electrode 112*a* receives substantially the same capacitance coupling effect and accordingly maintains substantially the same voltage level over the M scan periods TP_1~TP_M.

In comparison to a conventional display, the display 1 of the present embodiment controls the common electrode 112*a* to continuously have substantially the same voltage level, so that band mura is correspondingly eliminated and display quality is effectively improved.

Let an operating example be taken for example, a ratio of parameter K to parameter M of the present embodiment is substantially greater than or equal to 1/1000 and smaller than or equal to 1/5, and the value of K is adjustable. In an operating example with the parameter M being equal to 1080, the value of parameter K is substantially greater than 2 and substantially smaller than or equal to 216.

Let another operating example be taken for example. The control driving circuit 13 of the present embodiment is controlled by the timing sequence controller 15 to determine the timing sequence in the scan periods TP_1~TP_M.

In the present embodiment, the display panel 11 has two metal lines DL1 and DL2. However, the display 1 of the present embodiment is not limited to the above exemplification. In other examples, the display of the present embodiment may selectively have three or more than three metal lines disposed on the display panel, and the position of the metal lines is not limited to the underneath of the display panel. For example, the metal lines can be disposed in any part of the non-opening area covered by the common electrode.

Figure 6:
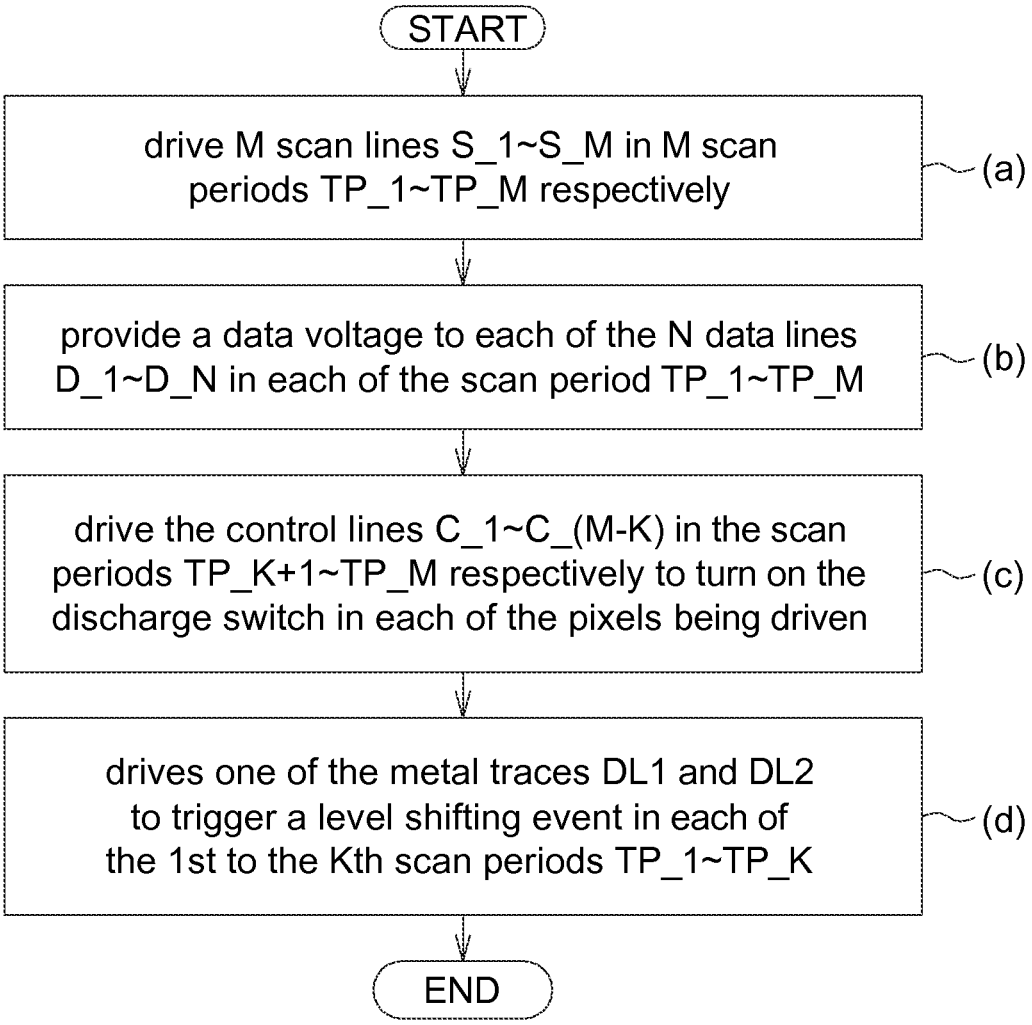
FIG. 6 shows a flowchart of a driving method according to a first embodiment of the invention.

Referring to FIG. 6, a flowchart of a driving method according to a first embodiment of the invention is shown. Detailed descriptions of each step of the driving method of the present embodiment are already disclosed in above passages, and are not repeated here.

Second Embodiment

Figure 7:
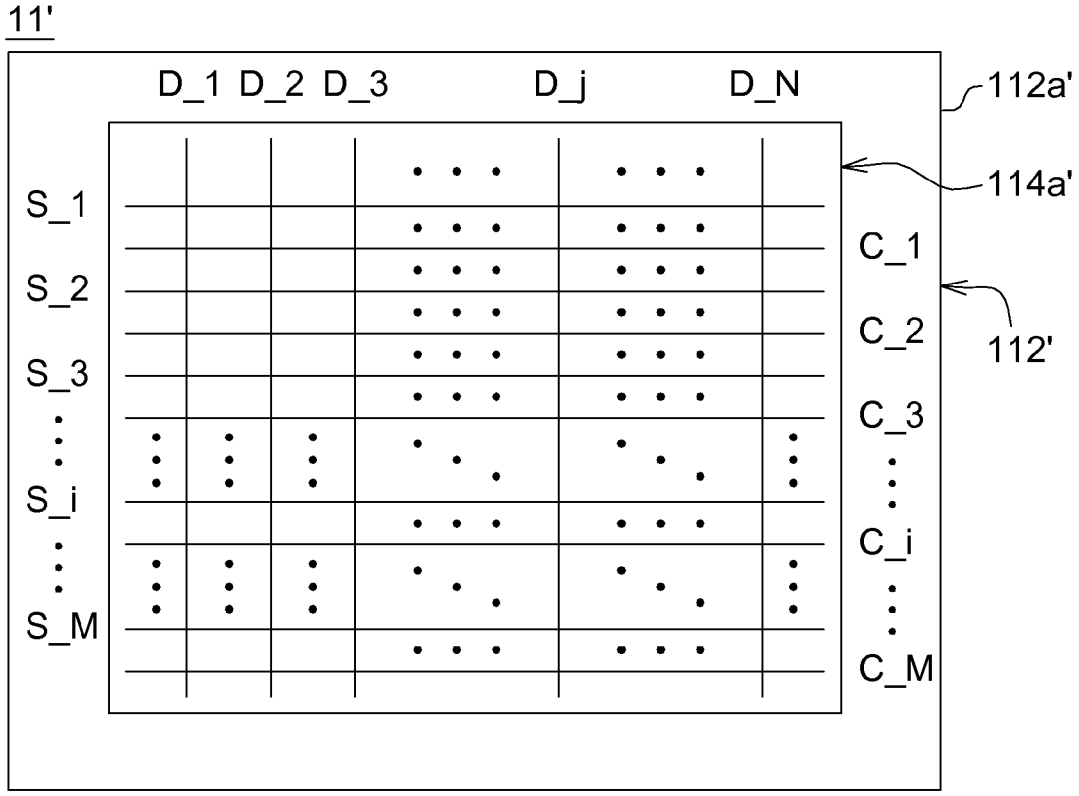
FIG. 7 shows a schematic diagram of a display panel according to a second embodiment of the invention.

Referring to FIG. 7, a schematic diagram of a display panel according to a second embodiment of the invention is shown. The display of the present embodiment is different from the display 1 of the first embodiment in that the display panel 11' does not have any metal lines, and the display of the present embodiment adjusts the wave-patterns of the control signals Cs'1~Cs'M−K to have additional level shifting events triggered on partial or all of the control lines C_1~C_M−K in each of the scan periods TP_1~TP_K.

Thus, the display 1' of the present embodiment may trigger substantially the same capacitance coupling event with respect to the common electrode in each of the scan periods, so that the common electrode maintains stable voltage level over all scan periods.

Figure 8:
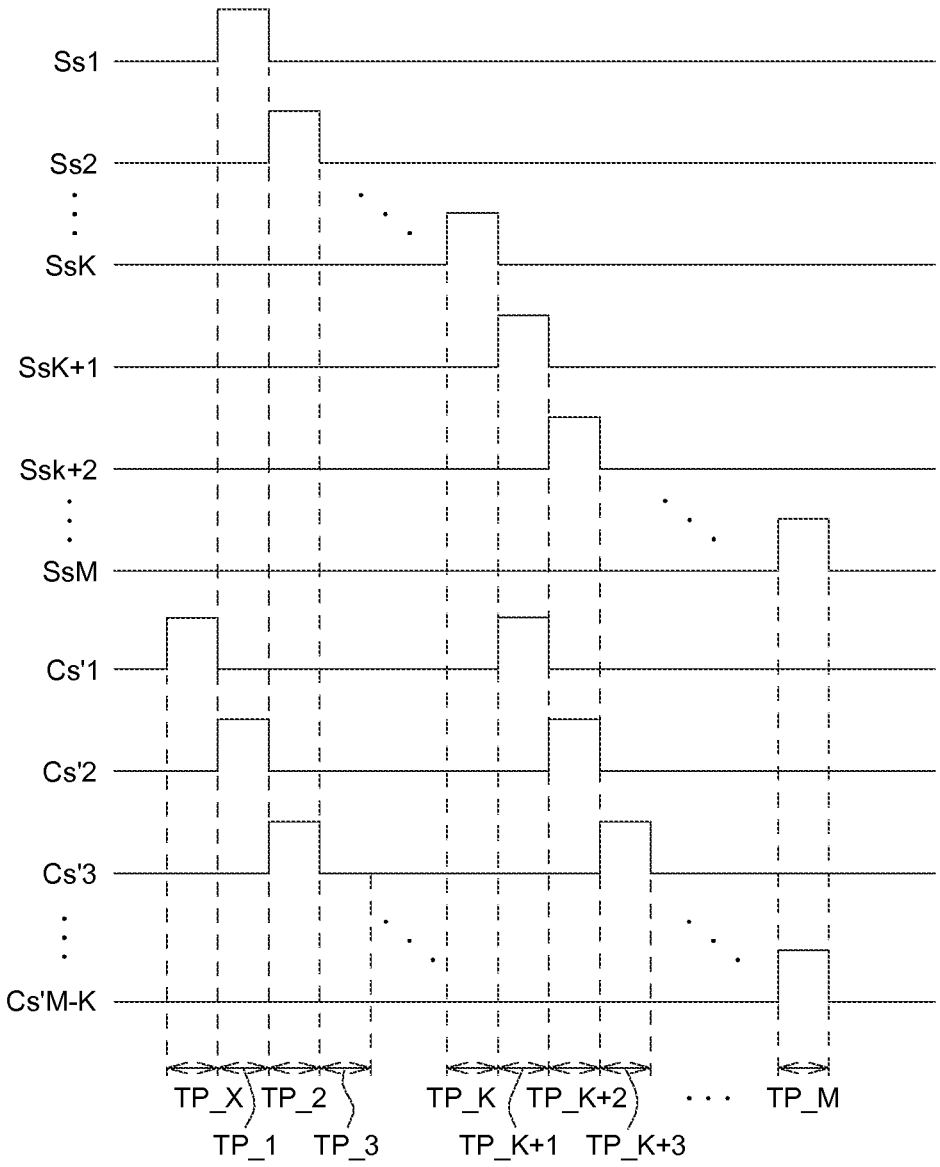
FIG. 8 shows related signal timing diagrams of a display according to a second embodiment of the invention.
Figure 9:
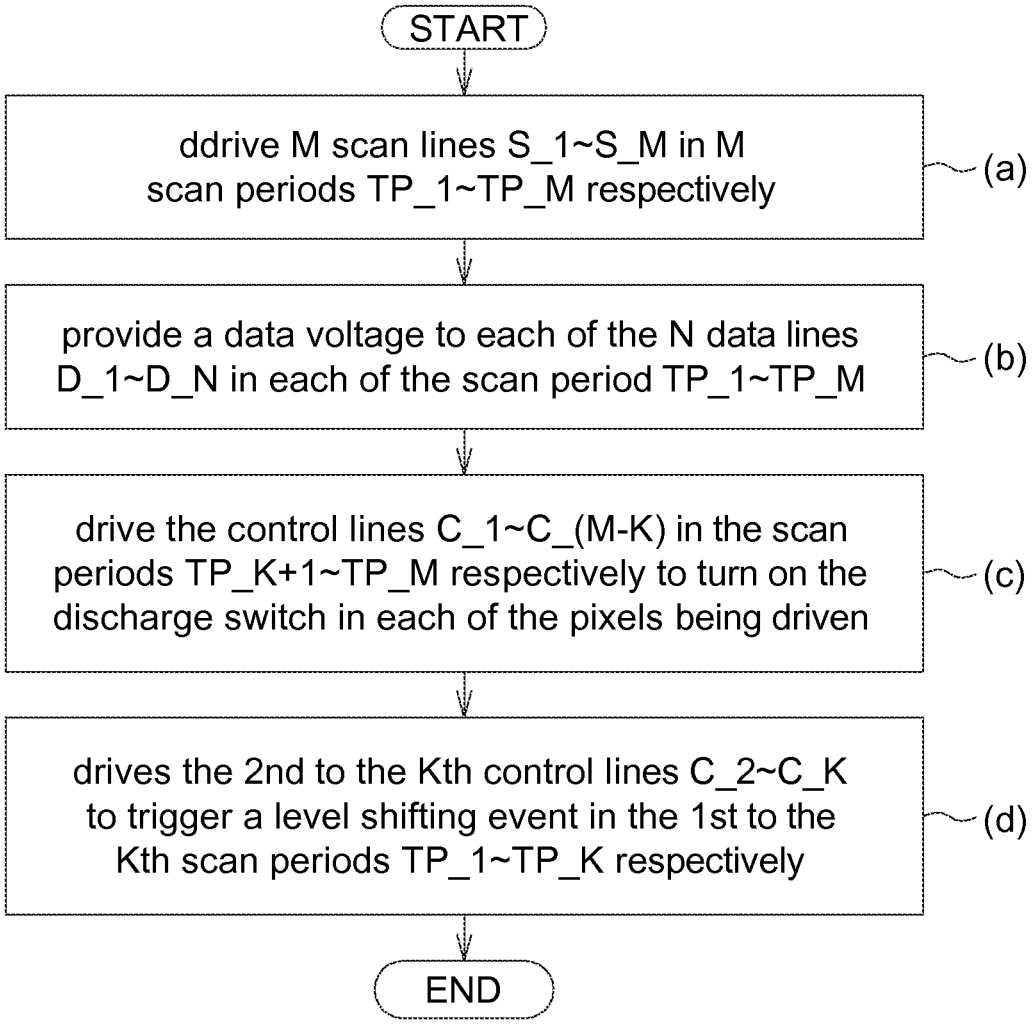
FIG. 9 shows a flowchart of a driving method according to a second embodiment of the invention.

Referring to FIG. 8, related signal timing diagrams of a display according to a second embodiment of the invention are shown. Over the scan periods TP_1~TP_M, the operations performed by the scan driver and the data driver of the display of the present embodiment are substantially the same with that performed by corresponding drivers of the first embodiment. Over the scan periods TP_K+1~TP_M, the operations performed by the control driver of the display of the present embodiment are substantially the same with that performed by the control driver 13 of the first embodiment. Therefore, operations performed by the scan driver and the data driver of the present embodiment are the same with that performed by corresponding drivers of the first embodiment, and are not repeated here.

In each of the scan periods TP_1~TP_K−1, the control driver of the present embodiment further drives the second to the $K^{th}$ control lines C_2~C_K of the M control lines C_1~C_M to trigger level shifting events in the first to the $(K-1)^{th}$ scan periods TP_1~TP_K−1 respectively. For example, the control driver of the present embodiment enables control signals Cs'2~Cs'K in the first to the $(K-1)^{th}$ scan periods TP_1~TP_K−1 to correspondingly drive the control lines C_2~C_K to trigger level shifting events in corresponding scan periods TP1~TP_K−1 respectively.

For the pixels on the rows correspondingly controlled by the control lines C_2~C_K (that is, pixels P(2,1)~P(K,N) on the second to the $K^{th}$ rows of the display panel 11'), the enable periods (scan periods TP_1~TP_K−1) of the control signals Cs'2~Cs'K received by the pixels are triggered prior to the enable periods (scan periods TP_2~TP_K) of the scan signals Ss2~SsK received by the pixels. In other words, apart from the LCS operation as disclosed in the first embodiment, the pixels P(2,1)~P(K,N) on the second to the $K^{th}$ rows are further designed to perform a pre-LCS operation before the data scanning operation is performed.

By performing the pre-LCS operation on pixels P(2,1)~P(K,N) on the second to the $K^{th}$ rows by the driving controller of the present embodiment, level shifting events are triggered on two metal wires in any of the scan periods TP_1~TP_K−1 and TP_K+1~TP_M. Thus, in each of M scan periods TP_1~TP_K−1 and TP_K+1~TP_M, the common electrode 112*a* receives substantially the same capacitance coupling effect, and accordingly maintains substantially the same voltage level over the scan periods TP_1~TP_K−1 and TP_K+1~TP_M.

Let an operating example be taken for example. The driving controller of the present embodiment further drives the first control line C_1 of the M control lines to trigger a level shifting event in the pre-operation period TPx prior to the first scan period TP_1. In other words, pixels P(1,1)~P(1,N) on the first row of the display panel 11' of the present embodiment are also designed to perform the pre-LCS operation.

In the present embodiment, the driving controller performs a pre-LCS operation on the pixels P(2,1)~P(K,N) on the second to the $K^{th}$ rows in each of the scan periods TP_1~TP_K, wherein the scan periods TP_1~TP_K are one period prior to the scan periods TP_2 ~TP_K corresponding to the pixels P(2,1)~P(K,N) on the second to the $K^{th}$ rows. However, the driving controller of the present embodiment is not limited thereto. In other examples, the driving controller may also perform the pre-LCS operation on the pixels two or more than two periods prior to the original scan periods corresponding to the pixels.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display, comprising: a first substrate having a common electrode; and a second substrate, comprising:

M scan lines, N data lines and M control lines, wherein M and N are natural numbers greater than 1;

a plurality of metal lines disposed on the second substrate and corresponding to the common electrode;

and M×N pixels, wherein the $(i,j)^{th}$ pixel comprises:

a first sub-pixel electrically connected to the $i^{th}$ of the M scan lines and the $j^{th}$ of the N data lines, wherein i and j respectively are a natural number smaller than or equal to M and a natural number smaller than or equal to N;

and a second sub-pixel electrically connected to the $i^{th}$ scan line, the $j^{th}$ data line and the $i^{th}$ control lines, wherein the second sub-pixel further has a discharge switch;

a scan driver electrically connected to the M scan lines for providing M scan signals to drive the M scan lines in the M scan periods respectively;

a data driver electrically connected to the N data lines for providing a data voltage to each of the N data lines in each of the M scan periods;

and a control driver electrically connected to each of the M control lines for providing (M−K) control signals to drive the first to the $(M-K)^{th}$ control lines in the $(K+1)^{th}$ to the $M^{th}$ scan periods respectively to turn the discharge switch in each of the pixels on the first to the $(M-K)^{th}$ control lines;

wherein, K is a natural number greater than 1 and equal to or smaller than M; the control driver further drives one of the metal lines to trigger a voltage level shifting event in each of the first to the $K^{th}$ scan periods, so that the voltage level shifting event is correspondingly triggered on one scan line and one metal line in each of the first to the $K^{th}$ scan periods, and the voltage level shifting event is correspondingly triggered on one scan line and one control line in each of the $(K+1)^{th}$ to M scan periods.

2. The display according to claim 1, wherein a ratio of parameter K to parameter M is substantially greater than or equal to 1/1000 and smaller than or equal to 1/5.

3. The display according to claim 2, wherein the parameter M is equal to 1080, and the value of the parameter K is substantially greater than 2 and substantially smaller than or equal to 216.

4. The display according to claim 1, wherein the value of the parameter K is adjustable.

5. The display according to claim 4, wherein further comprising:

a timing sequence controller electrically connected to the scan driver and the control driver for correspondingly controlling the timing sequence.

6. A display, comprising:

a first substrate having a common electrode; and a second substrate, comprising:

M scan lines, N data lines and M control lines, wherein M and N are natural numbers greater than 1;

and M×N pixels, wherein the $(i,j)^{th}$ pixel comprises:

a first sub-pixel electrically connected to the $i^{th}$ of the M scan lines and the $j^{th}$ of the N data lines, wherein i and j respectively are a natural number smaller than or equal to M and a natural number smaller than or equal to N;

and a second sub-pixel electrically connected to the $i^{th}$ scan line, the $j^{th}$ data line and the $i^{th}$ control line, wherein the second sub-pixel further has a discharge switch;

a scan driver electrically connected to the M scan lines for providing M scan signals to drive the M scan lines in the M scan periods respectively;

a data driver electrically connected to the N data lines for providing a data voltage to each of the N data lines in each of the M scan periods;

and a control driver electrically connected to each of the M control lines for providing (M−K) control signals to drive the first to the $(M-K)^{th}$ control lines in the $(K+1)^{th}$ to the $M^{th}$ scan periods respectively to turn the discharge switch in each of the pixels on the first to the $(M-K)^{th}$ control lines;

wherein, K is a natural number greater than 1 and equal to or smaller than M; the control driver further drives the second to the $K^{th}$ control lines to trigger voltage level shifting events in the first to the $(K-1)^{th}$ scan periods respectively, so that the voltage level shifting events are triggered on one scan line and one control line in each of the first to the $(K-1)^{th}$ and the $(K+1)^{th}$ to the $M^{th}$ scan periods, and the voltage level shifting event is correspondingly triggered on one scan line and one control line in each of the $(K+1)^{th}$ to the M scan periods.

7. The display according to claim 6, wherein a ratio of parameter K to parameter M is substantially greater than or equal to 1/1000 and smaller than or equal to 1/5.

8. The display according to claim 7, wherein the parameter M is equal to 1080, and the value of the parameter K is substantially greater than 2 and substantially smaller than or equal to 216.

9. The display according to claim 6, wherein the value of the parameter K is adjustable.

10. The display according to claim 6, further comprising:

a timing sequence controller electrically connected to the scan driver and the control driver for correspondingly controlling the timing sequence.

11. The display according to claim 6, wherein the control driver further drives the first control line of the M control lines to trigger a level shifting event in a pre-operation period prior to the first scan period.

12. A driving method applied in a display comprising a first substrate, a second substrate, a scan driver, a data driver and a control driver, wherein the first substrate has a common electrode, the second substrate comprises M scan lines, N data lines, M control lines and M×N pixels, M and N are natural numbers greater than 1, each of the M×N pixels comprises a first sub-pixel and a second sub- pixel, the second sub-pixel further has a discharge switch, and the driving method comprises:

applying the scan driver to provide M scan signals to drive the M scan lines in the M scan periods respectively;

applying the data driver to provide a data voltage to each of the N data lines in each of the M scan periods;

applying the control driver to provide (M−K) control signals to drive the first to the $(M-K)^{th}$ control lines in the $(K+1)^{th}$ to the $M^{th}$ scan periods respectively to turn the discharge switch in each of the pixels on the first to the $(M-K)^{th}$ control lines; wherein, K is a natural number greater than 1 and equal to or smaller than M, and applying the control driver to drive the second to the $K^{th}$ control lines to trigger voltage level shifting events in the first to the $(K\times1)^{th}$ scan periods respectively, so that the voltage level shifting events are triggered on one scan line and one control line in each of the first to the $(K-1)^{th}$ and the $(K+1)^{th}$ to the $M^{th}$ scan periods, and the voltage level shifting event is correspondingly triggered on one scan line and one control line in each of the $(K+1)^{th}$ to the M scan periods.

13. The driving method according to claim 12, wherein a ratio of parameter K to parameter M is substantially greater than or equal to 1/1000 and smaller than or equal to 1/5.

14. The driving method according to claim 13, wherein the parameter M is equal to 1080, and the value of the parameter K is substantially greater than 2 and substantially smaller than or equal to 216.

15. The driving method according to claim 12, wherein the value of the parameter K is adjustable.

16. The driving method according to claim 12, further comprising:

applying the control driver to drive the first control line of the M control lines to trigger the level shifting event in a pre-operation period prior to the first scan period.

* * * * *